US006857420B2

(12) United States Patent
Weimert

(10) Patent No.: US 6,857,420 B2
(45) Date of Patent: Feb. 22, 2005

(54) IGNITION COIL HAVING A CONNECTING DEVICE FOR CONTACTING A SPARK PLUG

(75) Inventor: Markus Weimert, Sonthofen (DE)

(73) Assignee: Robert Bosch GmbH, Stuttgardt (DE)

( * ) Notice: Subject to any disclaimer, the term of this patent is extended or adjusted under 35 U.S.C. 154(b) by 0 days.

(21) Appl. No.: 10/771,561

(22) Filed: Feb. 3, 2004

(65) Prior Publication Data

US 2004/0216723 A1 Nov. 4, 2004

(30) Foreign Application Priority Data

Feb. 3, 2003 (DE) ..... 103 04 138

(51) Int. Cl.[7] ..... H01F 38/12; F02P 15/00

(52) U.S. Cl. ..... 123/635; 123/169 PA; 336/107; 439/125

(58) Field of Search ..... 123/169 PA, 169 PH, 123/634, 635; 174/138 S; 336/96, 107; 439/125, 126, 128

(56) References Cited

U.S. PATENT DOCUMENTS 4,514,712 A * 4/1985 McDougal ..... 123/634
5,406,242 A * 4/1995 Klocinski et al. ..... 336/107
5,492,105 A * 2/1996 Nakajima et al. ..... 123/635

FOREIGN PATENT DOCUMENTS

DE 019927820 C1 * 7/2000 ..... H01F/38/12

* cited by examiner

*Primary Examiner*—Tony M. Argenbright
(74) *Attorney, Agent, or Firm*—Kenyon & Kenyon

(57) ABSTRACT

An ignition coil includes a connecting device for contacting a spark plug of an internal combustion engine, the connecting device being designed to have a sleeve made of insulating material. The sleeve is able to be connected at a first end section to a high voltage side of the ignition coil, and at a second end section has an accommodation for the spark plug. Furthermore, in the sleeve at least one conductive contact part, touching the spark plug, is situated for the electrical connection of the ignition coil to the spark plug. At the high voltage side of the ignition coil, between it and the spark plug, a plurality of electrically conductive modular components are able to be positioned, which in the installed state are connected in a detachable, electrically conducting manner.

18 Claims, 2 Drawing Sheets

IGNITION COIL HAVING A CONNECTING DEVICE FOR CONTACTING A SPARK PLUG

FIELD OF THE INVENTION

The present invention relates to an ignition coil having a connecting device for contacting a spark plug of an internal combustion engine.

BACKGROUND INFORMATION

In the case of ignition coils, for supplying with high voltage an ignition means, designed as a rule as a spark plug, of an internal combustion engine, which usually, in a housing, have a primary winding connected to a supply voltage and a secondary winding connected to the spark plug, as well as a soft magnetic core situated centrally to these, the connection of the ignition coil to the spark plug is carried out in practice via a sleeve made of insulating material, mostly of silicone rubber, which is drawn over a sort of connection piece of the ignition coil, and consequently forms a unit with the body of the ignition coil.

In order to contact the spark plug with the high voltage side of the ignition coil, as the contact means, in the sleeve there is usually a contact spring or alternatively an SAE (Society of Automotive Engineers) socket. In addition, parts of the secondary winding or a wound, longer interference-suppressing resistor may be situated in the sleeve.

Such a device of an interference-suppressing resistor, which is used for suppressing interference in the region of the high voltage terminal that is in connection to the secondary winding, is described, for instance, in German Patent No. DE 199 27 820.

Besides interference-suppressing resistors wound as usual, which are positioned as close as possible to the spark plug, so-called interference-suppressing resistors may also be positioned in rod-type ignition coils, in this case the ohmic proportion and accordingly also the interference-suppressing function in certain frequency ranges being low. In the latter case, an additional capacitor in the primary region of the ignition coil may be necessary.

In practice, diodes are also built into the ignition coil, which are used to suppress voltage that would be created at the beginning of the dwell time or the loading time of the ignition coil at the high voltage output of the ignition coil, and may result in undesired sparks at the spark plug. Such diodes are also designated as EFU (closing spark suppression) diodes. Such EFU diodes are high voltage diodes which, for example, use the avalanche effect or the Zener effect, and are made up, for example, of a series connection of semiconductor layers or pn junctions.

From practical experience, applications are also known in which single diodes are connected in series to a composite construction and mounted, for example, on a printed-circuit board. In summation, the respective reverse voltages of such serially connected diodes make up one high voltage diode.

The positioning of a diode may, in principle, take place on the low voltage side of the ignition coil, between the secondary winding and vehicle electrical system ground or vehicle electrical system plus, the diode also being designated as a "cold" diode; however, the diode may also be positioned on the high voltage side, between the secondary winding and the spark plug contacting as a so-called "hot" diode. For manufacturing reasons, in practice the low voltage side positioning of the diode is usually selected, although it is electrically less effective, since a diode positioned on the low voltage side permits a higher turn-on voltage than a diode positioned on the high voltage side.

Consequently, often the closing spark suppression function of a diode positioned on the low voltage side is not sufficient for ignition coils having a very rapid current rise, as are used, for example, in multi-spark systems and a 42 V vehicle electrical system.

Placing the diode on the low voltage side of the ignition coil is also problematical for reasons of space, since especially in the case of rod-type ignition coils the available space is very limited, and the diode gets in the way there.

In addition, the problem arises, in the case of positioning the diode on the low voltage side, that during operation, a reverse voltage of several thousand Volt is present at the diode, which is disadvantageous in the region of the primary plug, since in this region there is an increasing number of electronic components which are mostly mounted on printed-circuit boards. Consequently, in the available space in this region that is low anyhow, insulation distances still have to be observed in addition. A possibly interfering influence by high voltage pulses at the diode also has to be taken into consideration.

The ignition coils available in the trade show that mostly only one type of diode is applied for different types of ignition coil, which, to be sure, makes cost reduction achievable, but does not lead to a dimensioning of the diode that is adapted to the respective requirements. Therefore, in many cases the EFU diode is overdimensioned or not sufficiently dimensioned.

The same applies to interference-preventing resistors which, with respect to their resistance value, cannot be simply adapted to the requirements that are actually only able to be tested on the finished ignition coil. A subsequent change in the resistance value is connected with great expenditure, not the least being that the interference-preventing effect has to be ascertained empirically, possibly even on the vehicle.

In the case of known ignition coils, since the exchangeability of the diodes and resistors is extremely difficult, as a rule, the whole ignition coil is scrapped when a diode or a resistor fails on manufacturing final inspection.

It is therefore an object of the present invention to create an ignition coil, having a connecting device for contacting a spark plug of an internal combustion engine, using which the positioning of diodes and/or resistors adjusted to the requirements is able to be carried out in a constructively simple manner.

SUMMARY OF THE INVENTION

An ignition coil having a connecting device for contacting a spark plug or a comparable ignition means according to the present invention, at the high voltage side of the ignition coil, between it and the spark plug, a plurality of electrically conductive module components being positionable, which in the installed state are detachably electrically conducting, has the advantage that the interface between ignition coil and spark plug can be designed optimally for the respective application case, since module components, for instance, in the form of electrical resistors, diodes or even only electrically conducting dummy elements of the kind found in a modular system can be positioned on the high voltage side of the ignition coil.

The modular construction of the connecting device and the dimensioning, hereby made flexible, of the ignition coil makes it possible to design the ignition coil to have an overall length suitable for the respective application and to adapt it to different connections of spark plugs, voluminous structural and tooling changes for the whole ignition coil, as were usual in the related art, being avoided.

If a diode is required for the ignition coil and this is designed as a modular component of the connecting device, a diode in the primary region of the ignition coil can thereby be omitted. This makes more space available in the primary region of the ignition coil, and other electronic components to be positioned in this region, especially for ignition coils having a "narrow" type of construction, such as rod-type ignition coils, are easier to place.

Next to the gain in space in the primary region, high-voltage side positioning of the diode also has the advantage that high voltage potentials influencing other components in an interfering manner are avoided, and that one may do without an insulating encapsulation of the diode, that has reverse voltage applied to it, in the primary region of the ignition coil.

When a high voltage diode is required, cost advantages may be achieved by using a stack of connected detachable, electrically conducting diodes, since several single diodes strung together, each of which has a low reverse voltage, are more cost-effective than one comparable high voltage diode.

If several modular components are provided as the diode, the former may be designed both to be identical and to be different. The number of diodes and their embodiment are selected, in this context, according to the reverse voltage to be realized.

A modular component designed as an electrical resistor or as a diode may advantageously represent an unwired SMD component, of the kind known for surface mounting on printed-circuit boards.

An EFU diode fashioned in this way is extremely effective in voltage suppression and is able to be adapted to the requirements by leaving out or adding a single diode.

The embodiment of modular components used as electrical resistors in the SMD type of construction also clearly contributes to cost reduction, since a resistor made in this way is clearly more cost-effective than an expensive wound interference-suppressing resistor which also has a relatively great overall length.

The detachable electrically conducting device of modular components also makes it possible, in application cases in which a diode or a resistor is not required or not desired, to provide a cost-effective electrically conducting dummy element in the connecting device according to the present invention, such as a metal pin, for bridging the axial space between the high voltage side of the ignition coil and the spark plug.

In this context, it has proven effective to make the contact surface between the modular components planar in each case. To do this, it is advantageous if the modular components are designed to be tablet-shaped or cylindrical.

The modular components, in one simple design of the ignition coil, may be introduced directly into the sleeve of insulating material and stacked therein.

For a better guidance, the modular components may also be stacked inside the sleeve in a bushing, which is formed of a rigid plastic, and which can be inserted, without further encapsulation with insulating resin, directly into the sleeve that is made, for example, of silicone.

The connecting device, embodied in this fashion according to the present invention, consequently represents a tube-shaped high voltage connection, which is coupled to an ignition coil housing via a detachable connection. In this context, a necessary change of length of the ignition coil, so to produce compatibility with a special application, may also be implemented via another form design of the sleeve and/or shell that surround the modular components.

In one additional advantageous refinement of the ignition coil according to the present invention, the modular components may be stacked at the high voltage end of the secondary winding in a recess of the ignition coil housing, so that, in the sleeve of the connecting device, only the contact part conductingly connecting the modular components to the spark plug is still situated there.

Even though it is advantageous, for space reasons, to position the diodes and resistors as much as possible on the high voltage side of the ignition coil, it is also conceivable that one might position diodes or other electrically conductive modular components in the low voltage region of the ignition coil, while additional diodes and/or other electrically conductive modular components, such as interference-suppressing resistors, are situated in the region of the connecting device of the ignition coil according to the present invention.

The form of the ignition coil according to the present invention is applicable to any ignition coil types that are designed at least approximately tube-shaped on the high voltage side. In particular, the present invention is suitable for application in the case of rod-type ignition coils.

DETAILED DESCRIPTION

Figure 1:
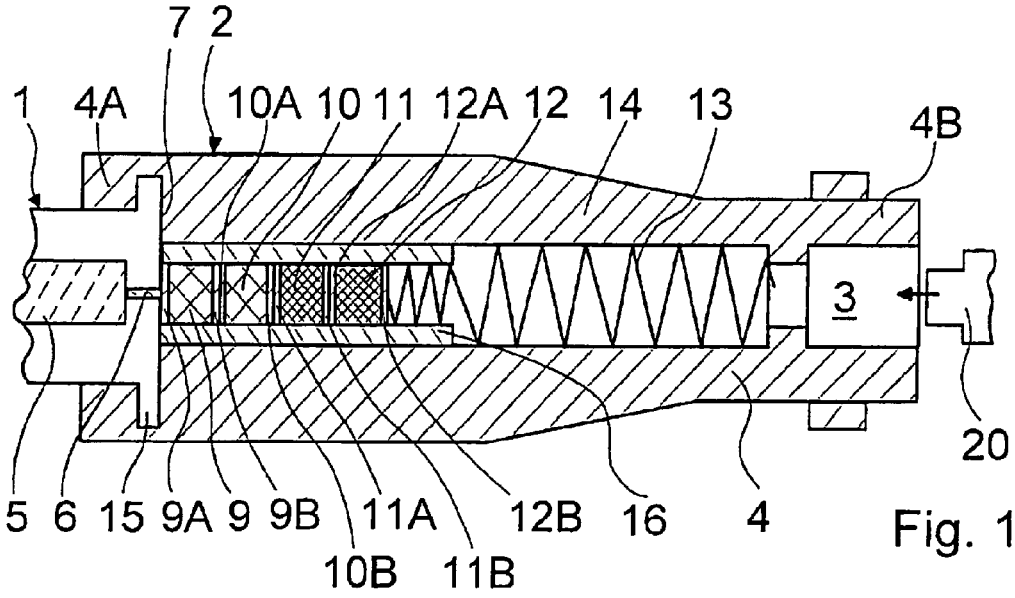
FIG. 1 shows a simplified section through a first embodiment of a connecting device of an ignition coil for contacting a spark plug of an internal combustion engine.
Figure 2:
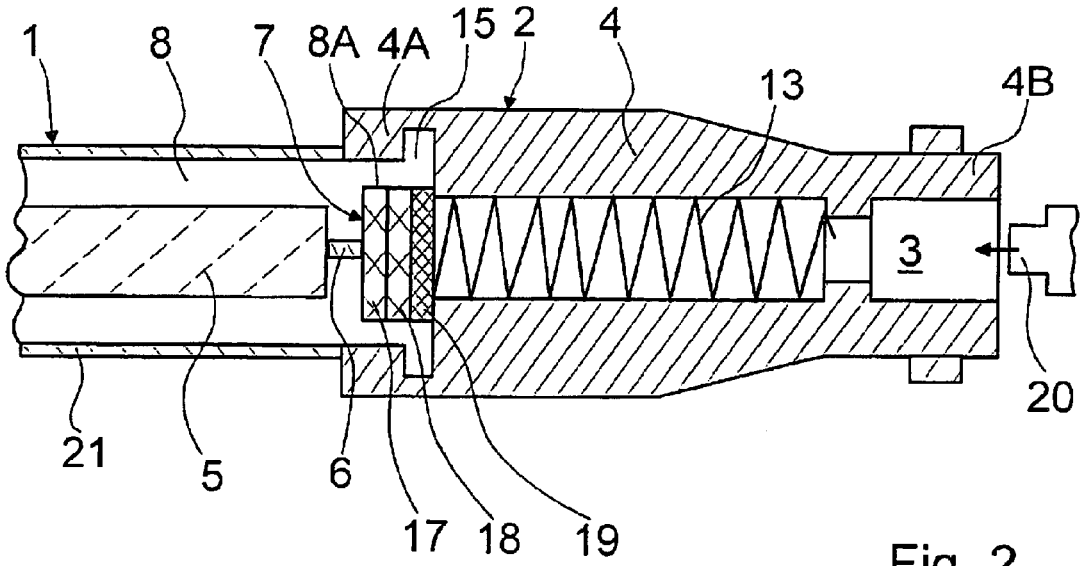
FIG. 2 shows a second specific embodiment of a connecting device of an ignition coil for contacting a spark plug of an internal combustion engine in a simplified longitudinal section.
Figure 3:
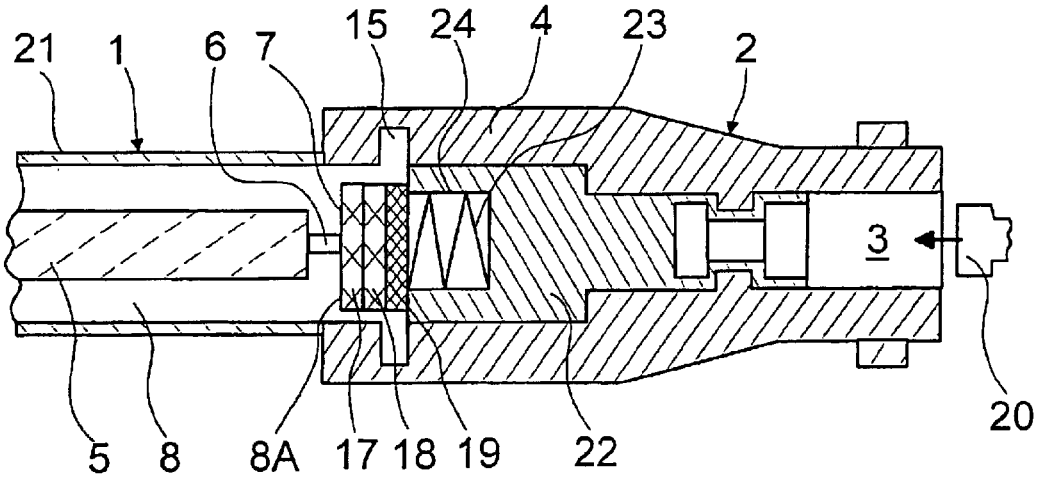
FIG. 3 shows a third specific embodiment of a connecting device of an ignition coil for contacting a spark plug in a simplified longitudinal section.

FIGS. 1 through 3 show in each case, in section and schematically, an ignition coil 1 developed in the embodiments shown in each case as a rod-type ignition coil. However, deviating from this, in other embodiments, the ignition coil may also be a so-called compact ignition coil or an ignition coil of another type of construction.

Ignition coil 1 in each case has a connecting device 2 for contacting a spark plug 20 of an internal combustion engine of the motor vehicle, spark plug 20, in each case only indicated schematically, may be of the usual construction type having a terminal stud according to SAE standards. The installation space of spark plug 20 or its terminal stud in connecting device 2 is denoted in FIGS. 1 through 3 in each case by reference numeral 3. In the installed position, having the terminal stud inserted into installation space 3, spark plug 20 is thus always situated coaxially to a longitudinal axis of ignition coil 1.

Ignition coil 1, which is, as presented here, developed essentially in a known manner, has a secondary winding 5, shown as a cutout in a secondary region in each of FIGS. 1 through 3, from which a high voltage emission via a high voltage output 6, also designated as a secondary wire, takes place, which leads to a high voltage side 7 of ignition coil 1 or an ignition coil housing 8. From high voltage side 7, a high voltage signal is transmitted via connecting device 2 to spark plug 20. For better contacting of conducting means adjoining high voltage side 7, high voltage output 6 may also be formed there using a metal platelet or the like.

As may also be seen in the figures, connecting device 2 is designed for high voltage transmission to spark plug 20, having several electrically conductive module components 9, 10, 11, 12 and 17, 18, 19 and one conductive contact part 13 or 23 that touches the terminal stud of spark plug 20, in the built-in state the module components and the contact part being each connected detachably and electrically conducting.

Connecting device 2 also has a sleeve 4 made of insulating material, sleeve 4, as present here, being formed in each case of tough-elastic silicone rubber, and in the installed state produces both a mechanical connection between rod-type ignition coil 1 and spark plug 20, consequently representing a sort of connecting plug, and also produces a protective jacket insulating the high voltage conducting elements between these components.

Sleeve 4 is formed essentially as a hollow cylinder and is connected by a first end section 4A via a snap-in connection to high voltage side 7 or ignition coil housing 8 in the high voltage side end region of ignition coil 1, by inverting sleeve 4 over an enlargement 15 formed on ignition coil housing 8. Deviating from this, one skilled in the art may also produce the connection between sleeve 4 and ignition coil housing 8 in another known way that is suitable for a respective application, for instance, via a friction-locking connection or an adhesive connection.

At a second end section 4B with respect to its axial extension, sleeve 4 has accommodation space 3 for the spark plug, as is also known from the related art.

In the embodiment shown in FIG. 1, between high voltage output 6 of secondary coil 5 and contact means 13, here representing a metal spring, for touching spark plug 20, two diodes 9, 10 and two resistors 11, 12 are situated, which each have a contact surface 9A, 10A, 11A, 12A facing ignition coil 1 and a contact surface 9B, 10B, 11B, 12B facing spark plug 20 and its installation space 3, as well as being designed cylindrically tablet-shaped. Modular components 9 through 12, representing the diodes and the electrical resistors, lie against one another with their bordering contact surfaces 9B, 10A and 10B, 11A in a planar manner respectively, they being pressed by contact means 13 formed as a metal spring, which borders on the spark plug side on modular components 9 through 12, against high voltage side 7 of ignition coil 1.

The spring force of metal spring 13 is selected, in this context, in such a way that a durable contacting between modular component 9 through 12 is ensured, whereby a durable connection, such as by soldering, is made unnecessary.

The shown construction having a modular stacking of the conducting components of connecting device 2 makes it possible to remove one or more of modular components 9 through 12 if necessary, and to replace them by a metal pin of appropriate length which represents an electrically conducting dummy element.

An additional insulation around modular components 9 through 12, for instance, in the form of an encapsulation material, is not absolutely necessary from an electrical point of view, since, as a rule, potential differences inside the stacked modular components are small.

In the embodiment shown in FIG. 1, for the better guidance of modular components 9 through 12, these are positioned in a bushing 16 made of rigid plastic, which is set into a cylindrical interior of sleeve 4, and borders on high voltage side 7 of ignition coil 1.

FIG. 2 also shows a rod-type ignition coil 1 corresponding to the ignition coil as in FIG. 1 with respect to its functioning, which is able to be connected to a spark plug 20 via a connecting device 2, connecting device 2, as in the embodiment according to FIG. 1, being designed using a tough-elastic sleeve 4 made of silicone rubber.

As in the embodiment according to FIG. 1, here, too, modular components 17, 18, 19 are positioned between high voltage side 7 of ignition coil 1 and contact means 13 that contacts spark plug 20 in the built-in state, contact means 13, in turn, being developed as a metallic contact spring, which ensures the required contact pressure for maintaining the contact between modular components 17, 18, 19 and the high voltage side 7 of ignition coil 1.

By contrast to the embodiment variant shown in FIG. 1, in the exemplary embodiment according to FIG. 2, modular components 17, 18, 19, which are also formed in tablet form, and of which two modular components 17, 18, situated on the coil side, are developed as diodes, and modular component 19, bordering on the spark plug side, is developed as a resistor, are situated not directly in sleeve 4, but rather in a corresponding recess 8A of ignition coil housing 8 as a stack. Consequently, only contact part 13 contacting spark plug 20 is still situated in sleeve 4 itself.

First modular component 17 on the ignition coil side, that is developed as a diode, lies in it with its contact surface against high voltage side 7 of ignition coil 1 or high voltage output 6, and forms a so-called "cold" connection with it by contact pressure. As in the embodiment according to FIG. 1, modular components 17, 18, 19 are connected to one another electrically conducting and detachably, the contact surface of first modular component 19 on the spark plug side, that is designed as a resistor, during assembly being accessible from the outside, and being electrically connected to spark plug 20 via spring-shaped contact part 13.

In this embodiment, modular components 17, 18, 19, together with secondary winding 5, should be securely insulated from the outside, because otherwise there is the danger of discharge to a magnetic interference sheet 21, which is usually situated at the outer side of ignition coil housing 8.

FIG. 3 shows a development of connecting device 2 of ignition coil 1 for contacting spark plug 20, that essentially corresponds to the embodiment variant shown in FIG. 2, modular components 17, 18, 19, in turn, being stacked in a recess 8A of ignition coil housing 8 on high voltage side 7 of ignition coil 1.

Instead of spring-shaped contact means 13 according to embodiments according to FIG. 1 and FIG. 2, a socket 22 designed according to the SAE standard is used here as contact means for transmitting a high voltage signal from modular components 17, 18, 19 to a correspondingly developed terminal stud of spark plug 20.

For the application of the contact force between the conducting components, in this case a spring 23 is provided between first modular component 19 on the spark plug side and socket 22, spring 23 in question being set into a central bore 24 of socket 22. Spring 23 in question is developed as a control spring made of metal, but it may also be developed as a disk spring or having another suitable type of construction.

In one refinement deviating from this, in an individual case, it may be meaningful from a manufacturing point of view to position metal spring 23 between high voltage side 7 of ignition coil 1 and first modular component 17 on the ignition coil side.

The embodiments shown only represent examples which are supposed to reflect the multiple positioning possibilities of the electrically conducting components between the ignition coil and the spark plug, in the region of the connecting device that connects these, and the flexibility of a modular construction according to the present invention.

What is claimed is:

1. An ignition coil comprising:

a connecting device for contacting a spark plug of an internal combustion engine, the connecting device including a sleeve composed of an insulating material, the sleeve being adapted to be connected at a first end section to a high voltage side of the ignition coil, the sleeve having an accommodation for the spark plug at a second end section;

at least one conductive contact part for contacting the spark plug, the conductive contact part being situated in the sleeve for an electrical connection of the ignition coil to the spark plug; and a plurality of electrically conducting modular components situated at the high voltage side of the ignition coil, between it and the spark plug, wherein the electrically conducting modular components, in an installed state, are connected in a detachable, electrically conducting manner.

2. The ignition coil according to claim 1, wherein at least one of the modular components is an electrical resistor.

3. The ignition coil according to claim 1, wherein at least one of the modular components is a diode.

4. The ignition coil according to claim 1, wherein at least one of the modular components is an electrically conducting dummy element.

5. The ignition coil according to claim 1, wherein one of the modular components lying closest to the spark plug is an electrical resistor.

6. The ignition coil according to claim 1, wherein the modular components contact one another in a planar manner when they are in the installed state.

7. The ignition coil according to claim 1, wherein the modular components are substantially tablet-shaped.

8. The ignition coil according to claim 1, wherein the modular components are stackable inside the sleeve.

9. The ignition coil according to claim 8, wherein the modular components are situated inside the sleeve in a bushing composed of rigid plastic.

10. The ignition coil according to claim 1, wherein the modular components are stackable in a recess of an ignition coil housing at a high voltage side end.

11. The ignition coil according to claim 1, further comprising a spring device situated at least in a region of the sleeve, with the aid of which the modular components are held to make contact with one another in the installed state.

12. The ignition coil according to claim 11, wherein the contact part touching the spark plug represents a socket.

13. The ignition coil according to claim 12, wherein the spring device is situated between the modular components and the socket.

14. The ignition coil according to claim 10, wherein the modular components are insulated from the outside together with a secondary winding of the ignition coil.

15. The ignition coil according to claim 11, wherein the spring device is the contact part touching the spark plug.

16. The ignition coil according to claim 1, wherein the sleeve is connected to a housing of the ignition coil in a detachable manner.

17. The ignition coil according to claim 1, wherein the ignition coil is at least substantially tube-shaped in a region of a connection to the sleeve.

18. The ignition coil according to claim 1, wherein the ignition coil is a rod-type ignition coil.

* * * * *